US008215479B2

(12) United States Patent
Willms et al.

(10) Patent No.: US 8,215,479 B2
(45) Date of Patent: Jul. 10, 2012

(54) COIN STORAGE AND DISPLAY DEVICE

(75) Inventors: James A. Willms, Cheyenne, WY (US); Eric Delaplaine, Cheyenne, WY (US); Cheryl Mefford, Cheyenne, WY (US)

(73) Assignee: Unicover Corporation, Cheyenne, WY (US)

( * ) Notice: Subject to any disclaimer, the term of this patent is extended or adjusted under 35 U.S.C. 154(b) by 201 days.

(21) Appl. No.: 12/541,264

(22) Filed: Aug. 14, 2009

(65) Prior Publication Data

US 2010/0084289 A1 Apr. 8, 2010

Related U.S. Application Data

(60) Provisional application No. 61/102,231, filed on Oct. 2, 2008, provisional application No. 61/122,554, filed on Dec. 15, 2008.

(51) Int. Cl.
*A45C 1/00* (2006.01)

(52) U.S. Cl. ..... 206/0.8; 206/0.84

(58) Field of Classification Search ..... 206/0.8, 206/0.81, 0.83, 0.84, 489, 459.5, 534, 815; 428/44

See application file for complete search history.

(56) References Cited

U.S. PATENT DOCUMENTS

| | | | | | |
|---|---|---|---|---|---|
| 2,139,150 | A | | 12/1938 | Curtis et al. | |
| 2,258,535 | A | * | 10/1941 | Buranelli | 206/0.84 |
| 2,291,755 | A | * | 8/1942 | Pierce | 206/517 |
| 2,985,284 | A | | 5/1961 | Levy | |
| 3,044,606 | A | * | 7/1962 | Frosh | 206/0.83 |
| 3,047,144 | A | | 7/1962 | Wissel | |
| 3,193,090 | A | | 7/1965 | Hudgeons, Sr. et al. | |
| 3,245,523 | A | | 4/1966 | White | |
| 3,543,426 | A | * | 12/1970 | Sakamoto | 40/710 |
| 3,788,464 | A | * | 1/1974 | Skinner | 206/0.82 |
| 3,913,732 | A | * | 10/1975 | Peterson | 206/0.83 |
| 4,063,639 | A | * | 12/1977 | Grant | 206/0.82 |
| 4,385,688 | A | * | 5/1983 | Grant | 206/0.83 |
| 5,191,972 | A | | 3/1993 | Helzer et al. | |
| 5,720,381 | A | | 2/1998 | Betancourt | |

(Continued)

FOREIGN PATENT DOCUMENTS

CH 666461 A5 7/1988

(Continued)

OTHER PUBLICATIONS

Notification of Transmittal of The International Search Report and The Written Opinion of the International Searching Authority, or The Declaration, Application No. PCT/US2009/056330, date of mailing Jan. 22, 2010.

(Continued)

*Primary Examiner* — J. Gregory Pickett
*Assistant Examiner* — Ernesto Grano
(74) *Attorney, Agent, or Firm* — Hamilton, Brook, Smith & Reynolds, P.C.

(57) ABSTRACT

A display for display articles such as coins or medallions including a generally planar plastic sheet having one or more retaining structures for capturing one or more display articles. The plastic sheet has opposite first and second generally planar sides. A first paper board sheet is bonded to the first side of the plastic sheet, and a second paper board sheet is bonded to the second side of the plastic sheet. The plastic sheet can have the same dimensions of at least one of the paper board sheets.

18 Claims, 5 Drawing Sheets

U.S. PATENT DOCUMENTS

| | | | | |
|---|---|---|---|---|
| 5,988,366 | A | 11/1999 | Krull et al. | |
| 6,025,040 | A | 2/2000 | Brockley | |
| 6,330,942 | B1 | 12/2001 | Raymond | |
| 6,379,765 | B1 | 4/2002 | Woods | |
| 6,394,499 | B1 | 5/2002 | Hanefeld et al. | |
| 6,604,627 | B1 | 8/2003 | Kennedy | |
| 6,644,468 | B1 | 11/2003 | Delk, Sr. | |
| 7,100,761 | B2 * | 9/2006 | Helzer et al. | 206/0.8 |
| 7,250,216 | B2 | 7/2007 | Taylor | |
| 7,299,918 | B1 | 11/2007 | Patrick | |
| 2002/0000387 | A1 | 1/2002 | Krull et al. | |
| 2004/0124110 | A1 | 7/2004 | Helzer et al. | |
| 2006/0008609 | A1 | 1/2006 | Snyder et al. | |
| 2006/0035052 | A1 | 2/2006 | Shih | |
| 2006/0060274 | A1 | 3/2006 | Duffy | |
| 2007/0241000 | A1 | 10/2007 | Irby | |
| 2008/0029417 | A1 * | 2/2008 | Begim | 206/461 |

FOREIGN PATENT DOCUMENTS

| | | | |
|---|---|---|---|
| DE | 17 97 024 | A1 | 9/1970 |
| DE | 86 20 939 | U1 | 11/1986 |
| EP | 0 112 445 | | 7/1984 |
| GB | 1 106 395 | A | 3/1968 |

OTHER PUBLICATIONS

Unicover Brochure for a coin portfolio, approximately 1998, and a description of features is included.

* cited by examiner

COIN STORAGE AND DISPLAY DEVICE

RELATED APPLICATION

This application claims the benefit of U.S. Provisional Application No. 61/102,231, filed on Oct. 2, 2008 and U.S. Provisional Application No. 61/122,554, filed on Dec. 15, 2008. The entire teachings of the above applications are incorporated herein by reference.

BACKGROUND

Current card board type display products for planar articles such as coins often consist of circular cavities within paper board, into which the coins can be inserted and snapped in place. Typically, the coins can only be viewed from one side. In addition, coins once in place, are not easily removed without damaging the coins or the circular cavities.

SUMMARY

The present invention can provide a display for display articles, or planar articles such as coins or medallions, including a generally planar plastic sheet having one or more retaining structures for capturing one or more display or planar articles. The plastic sheet has opposite first and second generally planar sides. A first paper board sheet can be bonded to the first side of the plastic sheet, and a second paper board sheet can be bonded to the second side of the plastic sheet. The plastic sheet can have generally the same dimensions of at least one of the paper board sheets.

In particular embodiments, the one or more retaining structures can be integrally formed in the plastic sheet. The plastic sheet can be formed of polyethylene terephthalate-glycol-modified (PETG). The first and second paper board sheets can have grains that are aligned in different directions. At least one paper board sheet can have one or more openings aligned with the one or more retaining structures. The paper board sheets can be bonded to the plastic sheet with a heat and pressure activated adhesive. The one or more retaining structures each can include a resilient side wall protruding from one of the generally planar sides of the plastic sheet. Multiple retaining structures can be molded in the plastic sheet for capturing multiple display articles. The retaining structures can be configured to capture display articles such as coins or medallions. Each retaining structure can include a generally circular resilient side wall.

In some embodiments, one of the paper board sheets can have multiple openings, each corresponding to a retaining structure for allowing the resilient side wall of each retaining structure to extend through one of the paper board sheets. In other embodiments, the other paper board sheet can also have multiple openings, each corresponding to a retaining structure to provide viewing through the other paper board sheet. In further embodiments, the generally planar plastic sheet can be a first generally planar plastic sheet. The display can further include a second generally planar plastic sheet having one or more retaining structures for capturing one or more display articles. One of the paper board sheets can be sized to be bonded to both the first and the second generally planar plastic sheets with a fold line extending between the first and second generally planar plastic sheets to allow the display to be folded.

The present invention can also provide a display for display articles including a generally planar plastic sheet having multiple retaining structures for capturing multiple display articles. The plastic sheet has opposite first and second generally planar sides. Each retaining structure can be integrally molded in the plastic sheet and have a resilient side wall protruding from one of the planar sides of the plastic sheet. A first paper board sheet can be bonded to the first side of the plastic sheet, and a second paper board sheet can be bonded to the second side of the plastic sheet. The plastic sheet can have generally the same dimensions of at least one of the paper board sheets. The first and second paper board sheets can have grains that are aligned in different directions. At least one paper board sheet can have multiple openings, each aligned with a corresponding retaining structure for allowing the resilient side wall of each retaining structure to extend through the at least one paper board sheet.

The present invention can also provide a method of forming a display for display articles including providing a generally planar plastic sheet having one or more retaining structures for capturing one or more display articles. The plastic sheet can have opposite first and second generally planar sides. A first paper board sheet can be bonded to the first side of the plastic sheet, and a second paper board sheet can be bonded to the second side of the plastic sheet. The plastic sheet can have generally the same dimensions of at least one of the paper board sheets.

In particular embodiments, one or more retaining structures can be integrally formed in the plastic sheet. The plastic sheet can be formed of polyethylene terephthalate-glycol-modified (PETG). Grains of the first and second paper board sheets can be aligned in different directions. One or more retaining structures can be aligned with one or more openings in at least one paper board sheet. The paper board sheets can be bonded to the plastic sheet with a heat and pressure activated adhesive under heat and pressure. In some embodiments, the adhesive can be activated under heat and pressure in a first press. The first press can be removed, and the paper board sheets can be sealed to the plastic sheet under heat and pressure in a second press. In one embodiment, the adhesive can be activated under heat and pressure in a first press at about 276° F. for about 3 seconds. The first press can be removed, and the paper board sheets can be sealed to the plastic sheet under heat and pressure in a second press at about 276° F. for about 3 seconds. In another embodiment, the adhesive can be activated under heat and pressure in a first press at about 280° F. for about 4 seconds. The first press can be removed, and the paper board sheets can be sealed to the plastic sheet under heat and pressure in a second press at about 275° F. for about 3.75 seconds.

The one or more retaining structures can be formed, each with a resilient side wall protruding from one of the generally planar sides of the plastic sheet. Multiple retaining structures can be molded in the plastic sheet for capturing multiple display articles. The retaining structures can be formed for capturing display articles, such as coins and medallions. Each retaining structure can be formed with a generally circular side wall. In some embodiments, one of the paper board sheets can be provided with multiple openings, each corresponding to a retaining structure for allowing the resilient side wall of each retaining structure to extend through the one of the paper board sheets. In other embodiments, the other paper board sheet can also be provided with multiple openings, each corresponding to a retaining structure to provide viewing through the other paper board sheet. In further embodiments, the generally planar plastic sheet can be a first generally planar plastic sheet, and a second generally planar plastic sheet can be provided having one or more retaining structures for capturing one or more display articles. One of the paper board sheets can be sized and bonded to both the first and second generally planar plastic sheets with a fold line extending between the first and second generally planar plastic sheets to allow the display to be folded.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
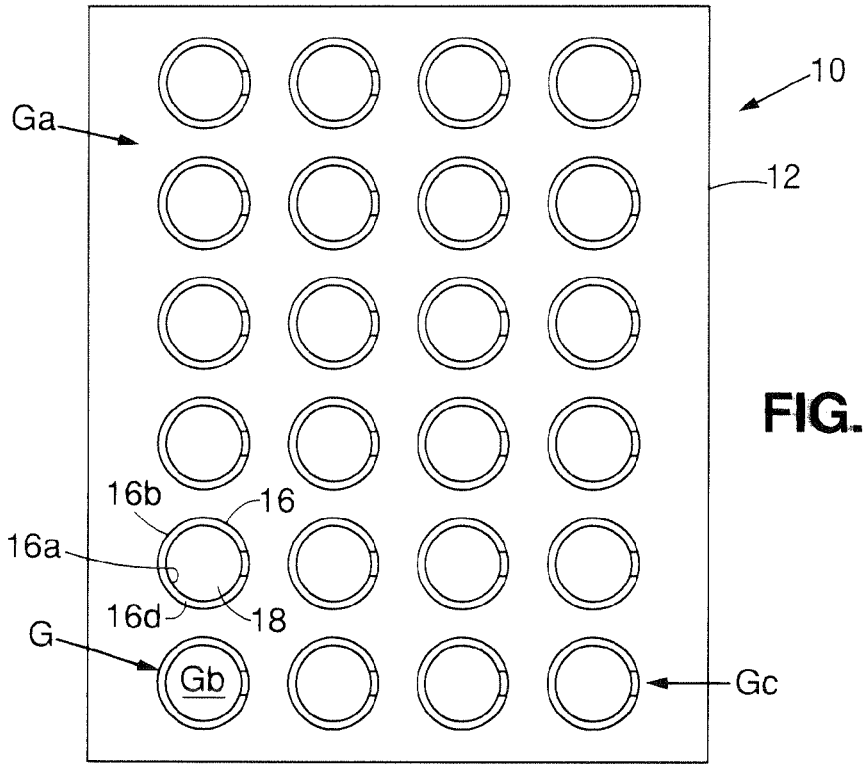
FIG. 1 is a top view of an embodiment of a mount sheet.

The present invention can provide a display device or product for display articles, which can be planar articles such as coins or medallions, in which the display articles may be snapped in and out of snap-in-snap-out mounts. Regions surrounding the snap-in-snap-out mount can be firmly sealed between two support or supporting material layers which can provide structural support. The display can comprise an integral mount sheet including one or more snap-in-snap-out mounts, which can be a semi-rigid, transparent plastic material, between two layers of support material, such as a rigid material, for example, paper board card stock, and which can be adhered together, for example, with adhesive. The snap-in-snap-out mounts can be aligned within an opening in the support layers so that the display article may be viewed or displayed either from one or both sides depending upon the embodiment. The support layers can have a high-gloss, heat-resistant coating applied.

The present invention can also provide a process for manufacturing the display. The display can consist of two support layers sealed to and sandwiching one inner layer made of plastic, all three of which in some embodiments, can be generally the same overall length and height. The snap-in-snap-out mount or mounts can be formed in and can be part of the plastic layer. The snap-in-snap-out mounts can be molded into plastic sheets, for example, ranging from about a 12 point (pt) thickness (about 0.012 inches) to about 13 pt thickness (about 0.013 inches). In other embodiments, the thickness can range from about 10 pt thickness (0.010 inches) to about 15 pt thickness (0.015 inches). The snap-in-snap-out mounts molded into the plastic sheet can hold their shape and firmly hold planar articles in place. When using 12 pt stock, sturdiness can be obtained to allow multiple display or planar articles to be displayed simultaneously without significant bending, folding, deforming or flexing.

Embodiments of the present invention display can allow users to protectively display or show articles (coins or medallions, such as United States Mint presidential golden dollars) so they are clearly visible and can be inserted and removed at will. The display can have added graphics and written information or text printed on the support layers to make a finished product. The display can be sold to users so they can place their display articles in the snap-in-snap-out mounts as they acquire them. Sealing two support layers of card stock to a plastic sheet can produce a more rigid overall product while still providing the flexibility needed for display articles to be snapped-in-snapped-out to the benefit of the user. In terms of product durability, the added stability of the solid plastic mount sheet of snap-in-snap-out mounts can provide a more functional and durable product. A given display can be of almost any size, and shape and contain one or multiple display articles on a single display mount sheet. The display can be sized correctly for displaying or storing multiple display articles such as coins for medallions on a single display. By sealing the support layer card stock over the plastic mount sheet, a more esthetically pleasing and rigid product can be produced offering a smooth surface while still providing the flexibility needed for display article insertion and removal on an "as-desired" basis. Once a display article has been inserted into a mount, it may be removed and inserted as often as the user desires without damaging the edges of the mount or other structural or cosmetic damage to the mount. A single, solid or integral plastic mount sheet can store and display more display or articles in a given space than individual mounts. The support layers may be formed with holes or openings, which can be die cut, on both sides to allow the display articles to be viewed on both sides.

In terms of productivity, a solid or integrally plastic mount sheet of snap-in-snap-out mounts can provide a dramatic labor savings during production. For example, an assembly of 24 separate individual mounts assembled together into a display can typically require about 18 employees for optimum quality. This could be reduced to 8 employees with a single mount sheet having multiple integrally formed snap-in-snap-out mounts sealed directly to support layers. This can result in more than a 50% reduction in labor cost. As a result, the present invention can result in superior product packaging, reduced labor costs, and quality display article presentation, use and storage.

Figure 2:
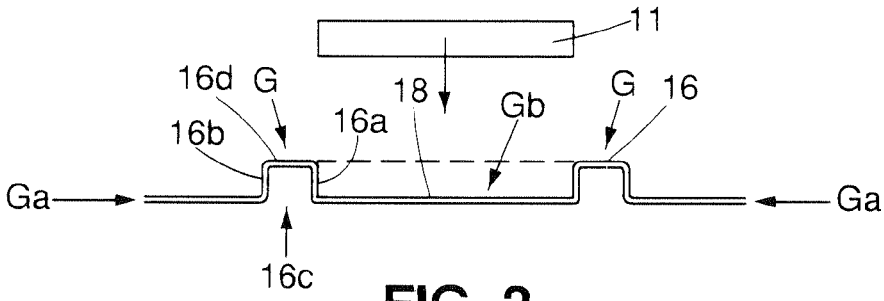
FIG. 2 is a side sectional view of one mount in the mount sheet for receiving a display article.
Figure 3:
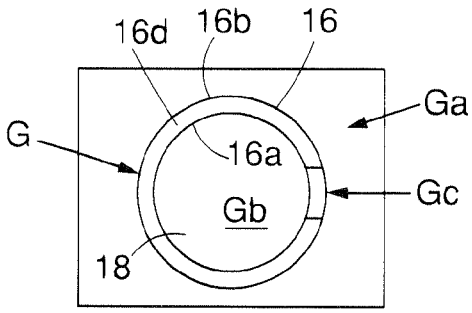
FIG. 3 is a top view of the mount of FIG. 2.

FIGS. 1-3 depicts an embodiment of a snap-in-snap-out mount sheet 10 which is one of the components that can be included in the present invention display. FIG. 1 shows an embodiment of a mount sheet 10 which is generally rectangular and capable of holding 24 display or planar articles or objects 11, such as disc shaped coins or medallions. The snap-in-snap-out mount sheet 10 can be made of a single plastic sheet 12 such as polyethylene terephthalate-glycol-modified (PETG), or other suitable plastic. PETG is a transparent plastic material that is often used because it can be extremely clear, non-reactive, and impact resistant. The mount sheet 10 can be formed of a plastic sheet 12 having a thickness ranging from about 10 pt to 15 pt, with either about 12 pt or 13 pt being common. The mount sheet 10 can include one or more retaining structures or snap-in-snap out mounting rings or mounts G, formed or molded in the plastic sheet 12, for example, under heat and pressure, such as in a die or a mold. For illustration, 24 mounts G are shown in FIG. 1, but the number can vary. The mount sheet 10 can include a single continuous integral flat or planar sheet area Ga extending between and connecting all of the mounts G to each other along a common plane. Each mount G can have a mounting area Gb in which a display article 11 such as a coin or medallion, can be placed or inserted and secured therein. Each mount G can have a resilient flange or side wall 16 protruding from the sheet 12 and sheet area Ga for resiliently accepting and gripping a display article 11. The resilient side wall 16 can have an inner wall 16*a* and an outer wall 16*b* separated from each other by a gap 16*c* and connected together by an upper wall 16*d*. In the embodiment shown, the resilient side wall 16 is generally curved or circular in shape, but alternatively, can have other suitable shapes for accommodating different shaped display articles 11. The inner wall 16*a* by itself, or together with the outer wall 16*b*, can deflect or deform outwardly, for example, radially outwardly to accept and grip, capture or retain the display article 11. The display article 11 can be seated on a flat or planar bottom 18 of the mounting area Gb. The planar bottom 18 can be positioned along the same plane as the flat or planar sheet area Ga. In other embodiments, the bottom 18 can be positioned above or below the plane of the sheet area Ga, or can be shaped to accept non planar display articles. A cutaway finger notch or notched portion Gc can extend through the side wall 16 of each mount G and can be sized for a person's finger, to allow the user to insert a finger and easily remove display articles 11 with the lift of a single finger.

Figure 4:
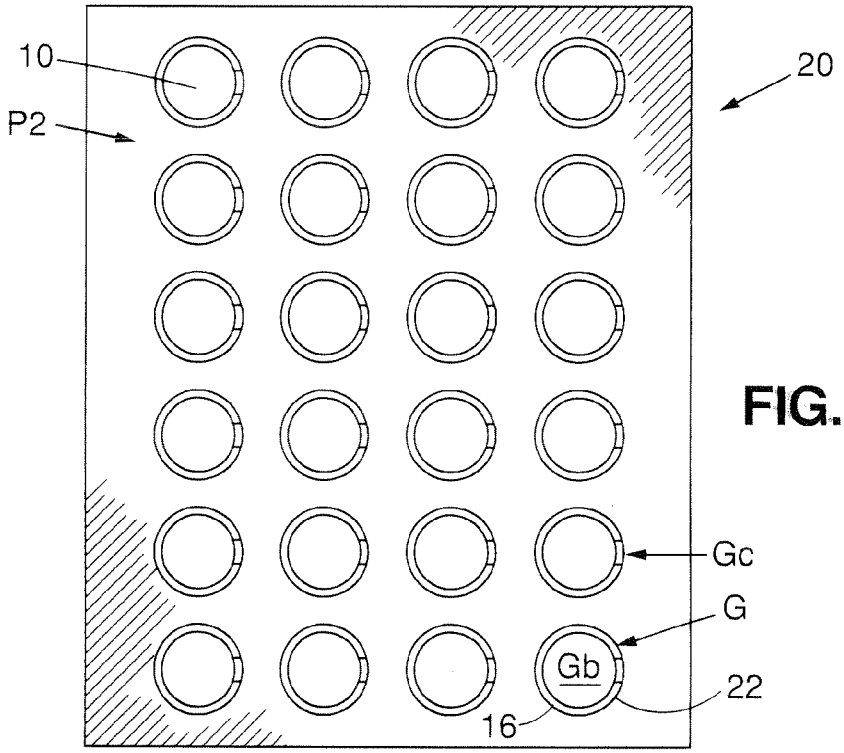
FIG. 4 is a top view of the mount sheet of FIG. 1 bonded between two support layers of paper board, forming an embodiment of a display.
Figure 5:
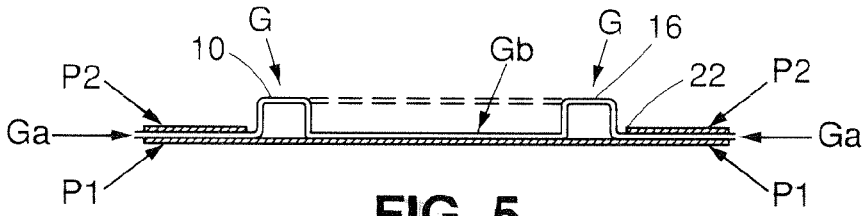
FIG. 5 is a side-sectional view of a portion of one embodiment of FIG. 4.
Figure 6:
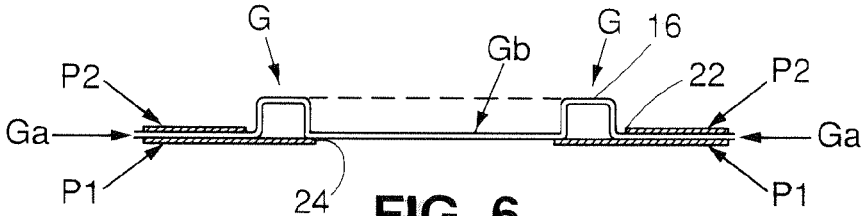
FIG. 6 is a side-sectional view of a portion of another embodiment of FIG. 4.

FIG. 4 shows an embodiment of a finished display device or product 20. The snap-in-snap-out mount sheet 10 can be sealed and adhered between two support or supporting material layers, first and second support layers P1 and P2, which can be paper board card stock. The adhesion of the support layers P1 and P2 to opposite planar sides of an integral mount sheet 10 can form a rigid laminate, and continuous planar surfaces can be adhered. Continuous surface adhesion on both sides of an integral mount 10 sheet can provide increased rigidity. The support layer P1 can be considered a bottom, back, rear, outer or exterior layer and the support layer P2 can be considered a top, front, inner, or interior layer. Only the support layer P2 is visible in FIG. 4. The support layer P1 is shown in the drawings of FIG. 5, and FIG. 6. The two support layers P1 and P2 can be sealed to the mount sheet 10, using heat and pressure. The resilient side walls 16 of mounts G protruding from the planar sheet area Ga of the mount sheet 10 can be aligned and extend through corresponding windows, holes or openings 22 within support layer P2. The openings 22 can be die cut into the support layer P2, or formed by other suitable means. The back of the display articles 11 may be concealed or covered by a solid support layer P1 to allow for the inclusion of more design graphics, as in one embodiment, such as shown in FIG. 5. The support layers P1 and P2 often have graphics, text, printing and UV treatment. By having openings 22, the support layer P2 can encircle each snap-in-snap-out mount G. The support layers P1 and P2 in the embodiment shown, can be exactly or generally the same size as the mount sheet 10.

In some embodiments, the back of the display articles 11 may also be revealed, such as shown in FIG. 6 where the support layer P1 includes windows, holes or openings 24 aligned with the mounts G to provide viewing from the back. The embodiment in FIG. 6 differs from the embodiment in FIG. 5 in that the openings 24 allows the reverse or back side of the display articles 11 to be also visible, providing two sided viewing. The openings 24 can be die cut holes, or can be formed by other suitable means. This embodiment can limit the amount of graphic and text application on the support layer P1.

Figure 7:
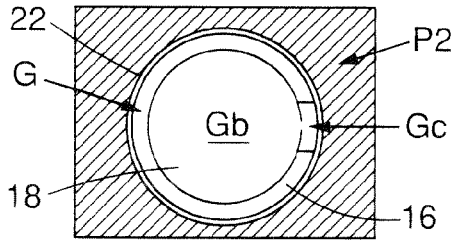
FIG. 7 is a top view of a mount region in FIG. 4.

FIG. 7 is an enlarged top view showing a portion of support layer P2 having an opening 22 therein for exposing the snap-in-snap-out mount G. The mount G can protrude through the opening 22 and can be encircled closely by the support layer P2, which can be more visually pleasing and can aid in the laminate's strength.

Figure 8:
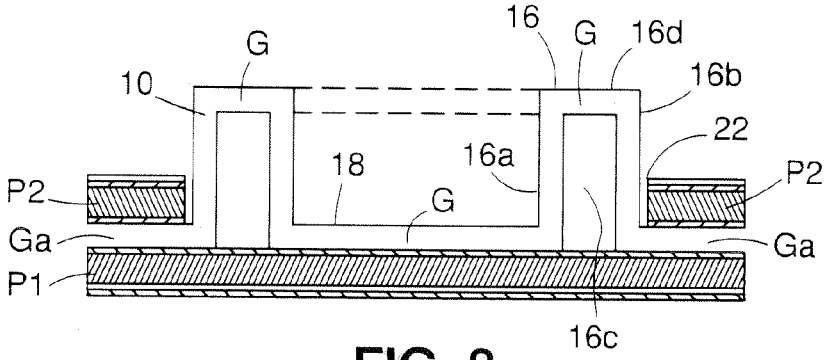
FIG. 8 is an enlarged schematic side sectional view of FIG. 5.
Figure 9:
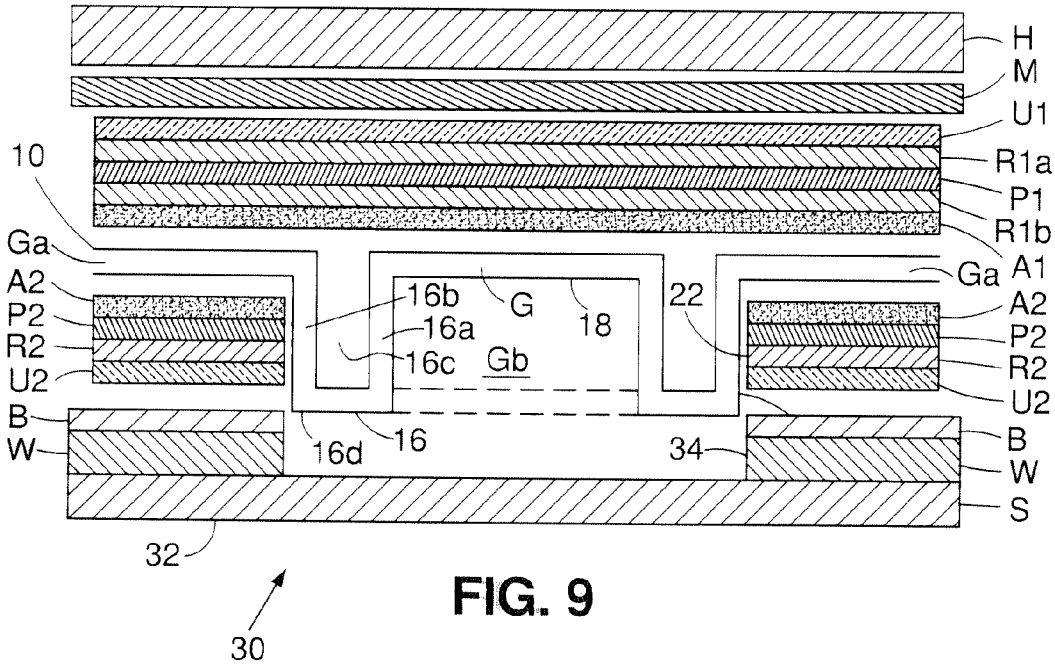
FIG. 9 is a schematic side sectional view of a portion of a display being assembled in a press.

FIGS. 8 and 9 illustrate components and associated materials used to manufacture the display 20. FIGS. 8 and 9 depict an area of the display 20 surrounding one mount G. It will be understood that a given display 20 can have multiple mounts G and can be manufactured in a variety of different sizes, shapes and configurations.

Support layers, P1 and P2, can be about 16-point (about 0.016 inches) thick card stock coated with a clay coating (e.g. C2S Carolina Cover), and can be printed with a variety of graphic and text designs using inks R1*a*, R1*b* and R2, respectively. In some embodiments, the thickness of layers P1 and P2 can range between 13 pt (0.013 inches) and 19 pt (0.019 inches). After printing, support layers P1 and P2 can coated with a high-gloss heat-resistant transparent coating, U1 and U2, which can be a UV cured coating. The interior sides of the support layers P1 and P2, can be selectively coated with a heat and pressure-activated adhesive, A1 and A2, which can be, for instance, a Latiseal-brand adhesive, or other suitable adhesive or sealing material. The support layer P2 can be formed with one or more holes or openings 22, such as by die cutting, and which can be circular and approximately the same diameter as the outside diameter of the snap-in-snap-out mount G. In some embodiments, the support layer P1 may also be formed with one or more holes or openings 24, as seen in FIG. 6. The openings 24 can be circular and approximately the same diameter as the mounting area Gb.

During manufacture, a press 30 having a heat and pressure sealing plate, head, or member H, and a bed structure 32, can receive and seal the various display components. The bed 32 can comprise a support surface S and a bed W, which can include one or more holes 34 that is slightly larger than the outer perimeter or diameter of corresponding mounts G of mount sheet 10. The bed 32 can also be layered with a compressible blanket material B that can be substantially free of surface imperfections. The blanket B can be, for example, a ground surface compressible blanket such as commonly used for web offset, sheet-fed, and box board printing applications, which will not adhere to the coating U2 at the temperatures required for sealing the display 20. The sealing head H can include a smooth polished steel plate. The support layer P2 can be placed onto the bed 32 so that the each opening 22 aligns with a corresponding hole 34 in the bed 32. Next, the mount sheet 10 can be placed on top of support layer P2 and aligned so that each opening 22 in layer P2 is concentric with a corresponding snap-in-snap-out mount G that protrudes through the openings 22. Next, the printed, coated, and die-cut support layer P1 can be placed on top of mount sheet 10.

A protective layer of material M having suitable thickness, such as a plastic layer, for example, Mylar-brand PET film, can be placed over the support layer P1 to prevent the sealing head H from adhering to coating U1 of support layer P1. Typically, the protective film layer M will not melt or adhere to the sealing head H or to the coating U1 at the temperatures required for sealing the display 20. Heat and pressure are then applied by sealing head H, which causes the display 20 to be laminated together. The temperature of the sealing head H can range from about 250° F. to about 290° F., and the pressure applied can range from about 140 lbs/in$^2$ to about 160 lbs/in$^2$, for about 3-10 seconds. In one embodiment, the temperature at the surface of the sealing head H can be approximately 260° F., the pressure applied can be about 150 lbs/in$^2$, and the dwell time (i.e. total amount of time that heat and pressure are applied) can be between about 3 and 8 seconds, for example, about 7 seconds.

In the manufacturing process, there can be a delicate balance between heat and dwell, for example, in some instances, as little as 5° F. can make a difference. Since the snap-in-snap-out mounts G are often manufactured through a heating process, the improper reapplication of heat can cause warping or distortion to the shape of the sheet area Ga and the individual mounts G. In some cases, the interior or exterior formation or dimensions of the mounts G can be changed. A "bubbling" air-pocket effect also can be created by the heating of the paper board support layers P1 and P2, and the plastic mount sheets 10 together with too much heat. The air-pocket effect between the paper board support layers P1 and P2, and plastic snap-in-snap-out mount sheets 10 can be eliminated by dropping the sealing temperature.

Figure 10:
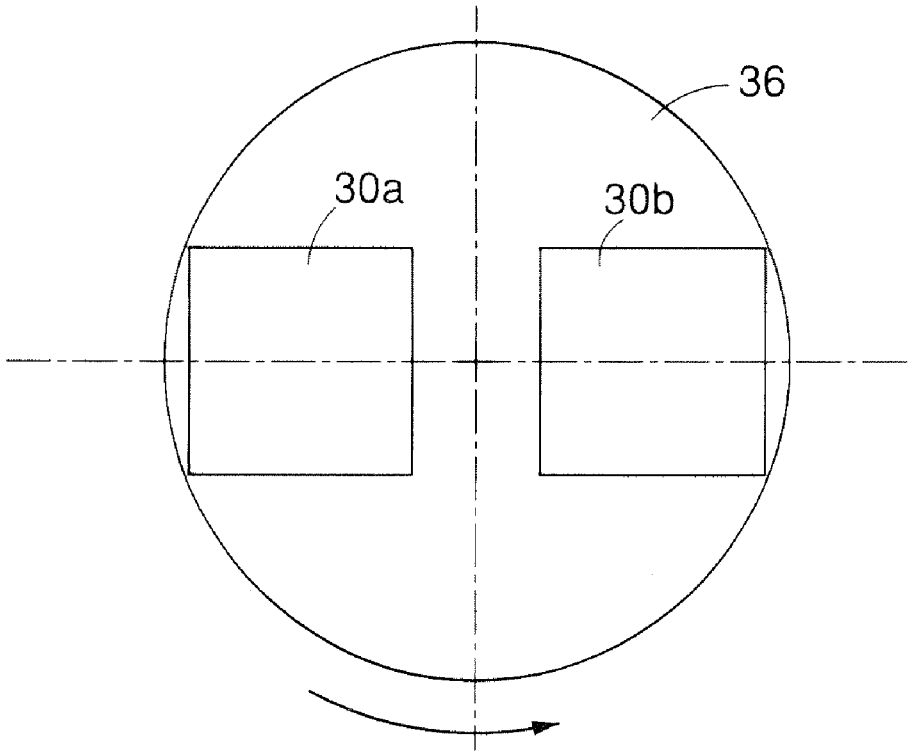
FIG. 10 is a schematic drawing of a press arrangement.

Referring to FIG. 10, in some embodiments, a two-step sealing process can be employed to protect the snap-in-snap-out mounts G and the paper board support layers P1 and P2 from distortion. By splitting the heat and dwell times between two separate sealing heads or presses 30*a* and 30*b*, the paper board support layers P1 and P2 can be adhered to the preformed plastic of the mount sheets 10 without destroying the integrity or shape of the mounts G or warping the plastic sheet areas Ga. The first sealing head or press 30*a* can preheat the sheets and activate the glue or adhesive under heat and pressure. After the first sealing head or press 30*a* is removed, there can be a delay of a couple of seconds before the second sealing head or press 30*b* engages for providing the actual sealing under heat and pressure. The temperature of the two sealing heads or presses 30*a* and 30*b* can be set at about 270° F. to 285° F., with staggered heating dwell times for each press 30*a* and 30*b* being about 2-5 seconds, with a delay of about 1-4 seconds between presses 30*a* and 30*b*. In one embodiment, the temperature of the two sealing heads or presses 30*a* and 30*b* can be set at 276° F., with a staggered dwell time of about 3 seconds for the sealing head or press 30*a*, and about 2.75 seconds (or about 3 seconds) for the second sealing head or press 30*b* and an index table 36 rotation speed of 35 about per minute, to obtain optimum balance.

Although particular temperatures and times have been described, these can be varied depending upon the situation at hand, for example, variations in the thicknesses and the materials used for display 20. The temperature can be increased or decreased, and the corresponding dwell time can be in some cases decreased or increased to compensate for the temperature change. In another embodiment, the temperature of the two separate presses can be about 280° F. for the first sealing head or press 30*a*, and about 275° F. for the second sealing head or press 30*b*, using about 150 lbs./in$^2$ of pressure with a staggered dwell time of about 4 seconds for the first sealing head or press 30*a*, and about 3.75 seconds for the second sealing head or press 30*b*, and employing an index table 36 having a rotation speed of about 35 per minute. Although, presses 30*a* and 30*b* have been described to be employed with a rotary index table, in other embodiments, presses 30*a* and 30*b* can be sequentially or linearly inline, for operating with sequential or linear movement. In addition, the thicknesses and sizes of mount sheet 10, and support layers P1 and P2 can be varied as desired.

Figure 11:
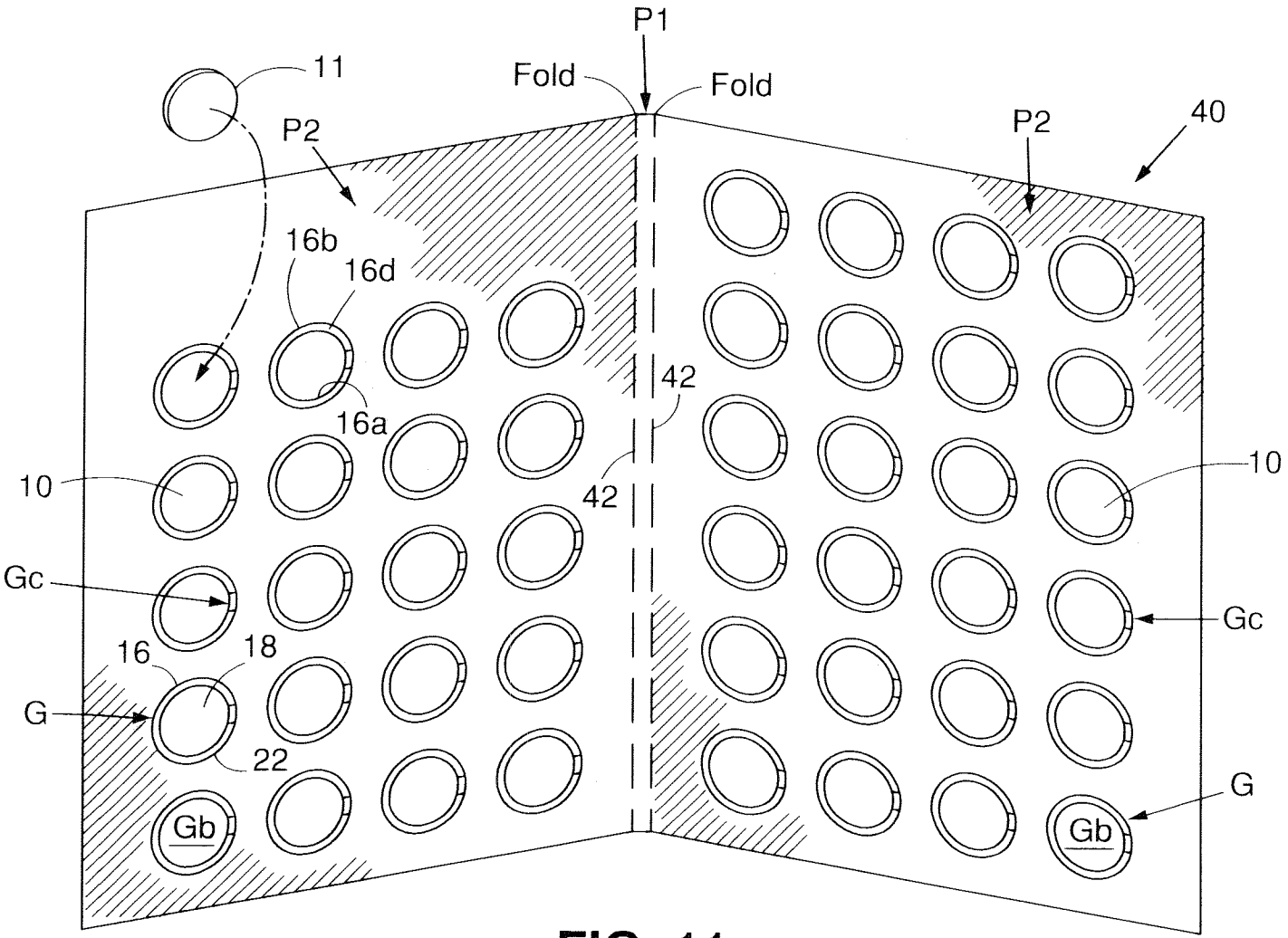
FIG. 11 is a perspective view of another embodiment of a display in the present invention.

FIG. 11 depicts a display device or product 40 which is another embodiment in the present invention which can be in a folder configuration. Support layer P1 can form an outer or exterior cover for the folder and two sheets of support layers P2 can form interior or inner display surfaces for the folder. The two mount sheets 10 can be on left and right hand inner sides of the display 40 with mounts G extending through openings 22 in support layers P2. The mount sheets 10 and the support layers P1 and P2 can be sealed in a similar manner as previously described. The support layer P2 can have hinges or joints, such as fold lines 42 extending between the mount sheets 10 and the support layers P2 to facilitate folding. The number of mounts G in the two mount sheets 10 can differ for example, in the embodiment shown, 20 mounts G in one, and 24 mounts G in the other. 13 pt thickness mount sheets 10 and 16 pt thickness support layers P1 and P2 can be used to provide enough strength and rigidity when laminated to support the weight of 44 display articles, such as metal coins or medallions. In addition, integrally forming multiple mounts G in a single sheet 12 with a protruding double wall configuration having an inner wall 16*a*, outer wall 16*b*, and top wall 16*d*, provides further rigidity to the overall mount sheet 10. In some embodiments, display 40 can have two plastic or PETG generally rectangular snap-in-snap-out mount sheets 10 which can be about 8.5×11.5 inches×13 pt thickness. Support layer P1 can be a single printed/scored/folded sheet that can be about 17.313×11.5 inches×16 pt thickness and folded along lines 42. Support layer P2 can include two printed and cut sheets that can be about 8.5×11.5 inches×16 pt thickness. For illustrative purposes, for one particular display article 11, the outer diameter of the snap-in-snap-out mounts G can be 1.326 inches, and the inner diameter can be 1.026 inches. The finger notch opening Gc can be 0.325 inches wide.

Figure 12:
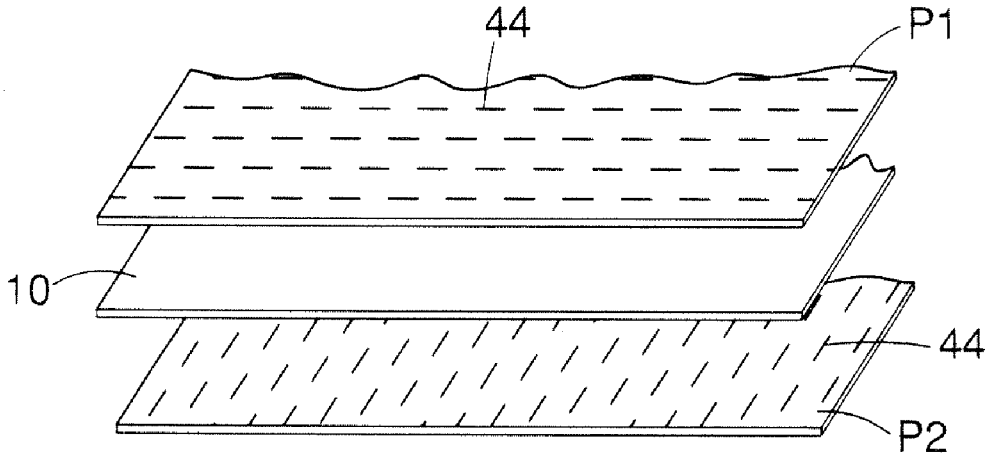
FIG. 12 is a schematic drawing depicting an example of grain orientation of the support layers when assembled with a mount sheet.

Referring to FIG. 12, the support layer P1 can have paper board grains 44 with a grain direction that can be parallel to the long dimension, for example, in display 40, the 17.313 dimension. The support layer P2 can have paper board grains 44 with a grain direction that is parallel to the long distance, for example, in display 40, the 11.5" direction. The support layers P1 and P2 can be laminated together with the grains 44 on the support layers P1 and P2 being oriented at transverse or right angles to each other, for pulling in different directions. The transverse grain 44 orientation along with using the proper heat and dwell, can prevent warping and make the product lay flat. The two different grain 44 directions can provide increased strength and can be resistant to warping when heat and pressure are applied. For example, the support layers P1 and P2 could in some situations expand and contract differently in the grain direction than across the grain direction under heat. As a result, orienting the grains of the support layers P1 and P2 at transverse or right angles can minimize or reduce such effects. It is understood that the grains 44 of support layers P1 and P2 can have other orientations relative to each other, such as at acute angles. It is understood that features such as the adhesion of the support layers P1 and P2 to opposite planar sides of an integral mount sheet 10, with the transverse grain 44 orientation described above, can be in other embodiments of displays in the present invention, including display 20.

While this invention has been particularly shown and described with references to example embodiments thereof, it will be understood by those skilled in the art that various changes in form and details may be made therein without departing from the scope of the invention encompassed by the appended claims.

Although the snap-in-snap-out mounts G have been shown in the figures as being generally round, it is understood that a number of different shapes can be used, depending on the shape of the article to be held, for example rectangular, oval, complex, etc., and that the sizes can vary, to accommodate different shaped and sized display articles 11. Openings 22 and 24 would also be shaped in a corresponding manner. In addition, although the snap-in-snap-out mounts G have been shown to be formed in an integral sheet of plastic 12, in other embodiments, individual mounts G can be secured to a sheet of plastic, or other suitable material, such as paper board. Furthermore, the mounts G can be made of other suitable materials or have other configurations. It is understood that the number of mounts and the size of the display can vary. For example, only one mount can be on any desired sized sheet, or 24 mounts can be on a 8.5 inch×11.5 inch sheet, four columns across the 8.5 inch width, and six rows down the 11.5 inch height. Embodiments of the display can be sturdy enough to withstand the weight of coins filling such a number and density of mounts G. The size and number of the mounts can be varied as desired. A special cutting die can be made to cut the snap-in-snap-out mount sheets 10 to allow for flush corners of paper stock and plastic on the finished display instead of cutting the sheets with round corners, which is usually the norm. Other embodiments of displays can include more than two mount sheets 10, and can be in a book configuration. In addition, in some embodiments, more than one mount sheet can be sandwiched between first and second support layers P1 and P2.

What is claimed is:

1. A display for display articles comprising:

a generally planar plastic sheet having multiple retaining structures integrally formed therein for capturing multiple display articles, the plastic sheet having opposite first and second generally planar sides of a continuous flat sheet area extending between and integrally connecting the retaining structures to each other and having a thickness ranging from about 10 pt thickness to about 15 pt thickness, each retaining structure being integrally molded in the plastic sheet, and having a mounting area with a bottom, surrounded by a resilient flange comprising an outer side wall protruding from one of the generally planar sides of the plastic sheet that surrounds and is connected to an inner side wall by an upper wall, the inner and outer walls being separated from each other by a gap;

a first paper board sheet bonded to the first side of the plastic sheet; and a second paper board sheet bonded to the second side of the plastic sheet, the plastic sheet having generally the same dimensions of at least one of the paper board sheets, the first and second paper board sheets each having a thickness ranging from about 13 pt thickness to about 19 pt thickness and having mating planar surfaces that are surface bonded with a heat activated adhesive to the first and second generally planar sides of said flat sheet area of the plastic sheet under heat and pressure in a manner that causes little distortion of the generally planar sides and the retaining structures, by applying a first application of heat and pressure, removing the first application of heat and pressure for about 1-4 seconds, and applying a second application of heat and pressure.

2. The display of claim 1 in which the plastic sheet is formed of polyethylene terephthalate-glycol-modified (PETG).

3. The display of claim 2 in which the first and second paper board sheets have grains that are aligned in different directions, at least one paper board sheet having openings aligned with the retaining structures.

4. The display of claim 1 in which the retaining structures are configured to capture display articles that are selected from the group consisting of coins and medallions.

5. The display of claim 1 in which each retaining structure comprises a generally circular resilient side wall.

6. The display of claim 1 in which one of the paper board sheets has multiple openings, each corresponding to a retaining structure for allowing the resilient side walls of each retaining structure to extend through said one of the paper board sheets, and the other paper board sheet has multiple openings, each corresponding to a retaining structure to provide viewing through said other paper board sheet.

7. The display of claim 1 in which the generally planar plastic sheet is a first generally planar plastic sheet, the display further comprising a second generally planar plastic sheet having one or more retaining structures for capturing one or more display articles, one of the paper board sheets being sized to be bonded to both the first and second generally planar plastic sheets with a fold line extending between the first and second generally planar plastic sheets to allow the display to be folded.

8. A display for display articles comprising:

a generally planar plastic sheet having multiple retaining structures for capturing multiple display articles, the plastic sheet having opposite first and second generally planar sides of a continuous flat sheet area extending between and integrally connecting the retaining structures to each other and having a thickness ranging from about 10 pt thickness to about 15 pt thickness, each retaining structure being integrally molded in the plastic sheet, and having a mounting area with a bottom, surrounded by a resilient flange comprising an outer side wall protruding from one of the generally planar sides of the plastic sheet that surrounds and is connected to an inner side wall by an upper wall, the inner and outer walls being separated from each other by a gap;

a first paper board sheet bonded to the first side of the plastic sheet; and a second paper board sheet bonded to the second side of the plastic sheet, the plastic sheet having generally the same dimensions of at least one of the paper board sheets, the first and second paper board sheets each having a thickness ranging from about 13 pt thickness to about 19 pt thickness and having mating planar surfaces that are surface bonded with a heat activated adhesive to the first and second generally planar sides of said flat sheet area of the plastic sheet under heat and pressure in a manner that causes little distortion of the generally planar sides and the retaining structures, by applying a first application of heat and pressure, removing the first application of heat and pressure for about 1-4 seconds, and applying a second application of heat and pressure, the first and second paper board sheets having grains that are aligned in different directions, at least one paper board sheet having multiple openings, each aligned with a corresponding retaining structure for allowing the resilient side wall of each retaining structure to extend though said at least one paper board sheet.

9. A method of forming a display for display articles comprising:

providing a generally planar plastic sheet having multiple retaining structures integrally formed therein for capturing multiple display articles, the plastic sheet having opposite first and second generally planar sides of a continuous flat sheet area extending between and integrally connecting the retaining structures to each other and having a thickness ranging from about 10 pt thickness to about 15 pt thickness, each retaining structure being integrally molded in the plastic sheet, and having a mounting area with a bottom, surrounded by a resilient flange comprising an outer side wall protruding from one of the generally planar sides of the plastic sheet that surrounds and is connected to an inner side wall by an upper wall, the inner and outer walls being separated from each other by a gap; and bonding a first paper board sheet to the first side of the plastic sheet and a second paper board sheet to the second side of the plastic sheet, the plastic sheet having generally the same dimensions of at least one of the paper board sheets, the first and second paper board sheets each having a thickness ranging from about 13 pt thickness to about 19 pt thickness and having mating planar surfaces that are surface bonded with a heat activated adhesive to the first and second generally planar sides of said flat sheet area of the plastic sheet under heat and pressure in a manner that causes little distortion of the generally planar sides and the retaining structures, by applying a first application of heat and pressure, removing the first application of heat and pressure for about 1-4 seconds, and applying a second application of heat and pressure.

10. The method of claim 9 further comprising forming the plastic sheet of polyethylene terephthalate-glycol-modified (PETG).

11. The method of claim 10 further comprising:

aligning grains of the first and second paper board sheets in different directions; and aligning the retaining structures with openings in at least one paper board sheet.

12. The method of claim 9 further comprising:

activating the adhesive under heat and pressure in a first press;

removing the first press; and sealing the paper board sheets to the plastic sheet under heat and pressure in a second press.

13. The method of claim 9 further comprising:

activating the adhesive under heat and pressure in a first press at about 276° F. for about 3 seconds;

removing the first press; and sealing the paper board sheets to the plastic sheet under heat and pressure in a second press at about 276° F. for about 3 seconds.

14. The method of claim 9 further comprising:

activating the adhesive under heat and pressure in a first press at about 280° F. for about four seconds;

removing the first press; and sealing the paper board sheets to the plastic sheet under heat and pressure in a second press at about 275° F. for about 3.75 seconds.

15. The method of claim 9 further comprising forming the retaining structures for capturing display articles selected from the group consisting of coins and medallions.

16. The method of claim 9 further comprising forming each retaining structure within a generally circular resilient side wall.

17. The method of claim 9 further comprising:

providing one of the paper board sheets with multiple openings, each corresponding to a retaining structure for allowing the resilient side wall of each retaining structure to extend through said one of the paper board sheets; and providing the other paper board sheet with multiple openings, each corresponding to a retaining structure to provide viewing through said other paper board sheet.

18. The method of claim 9 in which the generally planar plastic sheet is a first generally planar plastic sheet, the method further comprising:

providing a second generally planar plastic sheet having one or more retaining structures for capturing one or more display articles; and sizing and bonding one of the paper board sheets to both the first and second generally planar plastic sheets with a fold line extending between the first and second generally planar plastic sheets to allow the display to be folded.

* * * * *